US010532870B2

(12) United States Patent
Baud et al.

(10) Patent No.: US 10,532,870 B2
(45) Date of Patent: Jan. 14, 2020

(54) DEVICE FOR CONVEYING A BAG COMPRISING A BIOPHARMACEUTICAL FLUID AND SYSTEMS AND A METHOD USING SAME

(71) Applicant: SARTORIUS STEDIM FMT SAS, Aubagne (FR)

(72) Inventors: Stephane Baud, La Bouilladisse (FR); Isabelle Gay, Peypin (FR); Danilo Ponassi, Ollioules (FR)

(73) Assignee: SARTORIUS STEDIM FMT SAS, Aubagne (FR)

( * ) Notice: Subject to any disclaimer, the term of this patent is extended or adjusted under 35 U.S.C. 154(b) by 0 days.

(21) Appl. No.: 15/556,567

(22) PCT Filed: Mar. 8, 2016

(86) PCT No.: PCT/FR2016/050526
§ 371 (c)(1),
(2) Date: Sep. 7, 2017

(87) PCT Pub. No.: WO2016/142618
PCT Pub. Date: Sep. 15, 2016

(65) Prior Publication Data

US 2018/0050856 A1 Feb. 22, 2018

(30) Foreign Application Priority Data

Mar. 9, 2015 (FR) ..... 15 51955

(51) Int. Cl.
*B65D 77/06* (2006.01)
*B65D 81/05* (2006.01)
(Continued)

(52) U.S. Cl.
CPC ..... *B65D 77/06* (2013.01); *A61J 1/05* (2013.01); *B65D 3/02* (2013.01); *B65D 35/08* (2013.01);
(Continued)

(58) Field of Classification Search
CPC ..... A61J 1/05; A61M 5/148; A61M 5/152; A61M 37/00; A61M 5/142; B65D 3/02;
(Continued)

(56) References Cited

U.S. PATENT DOCUMENTS 4,857,055 A 8/1989 Wang
5,826,723 A 10/1998 Jaszai
(Continued)

FOREIGN PATENT DOCUMENTS

FR 1 376 830 A 10/1964
JP 2004203488 A * 7/2004
(Continued)

OTHER PUBLICATIONS

International Search Report, dated May 25, 2016, from corresponding PCT application No. PCT/FR2016/050526.

*Primary Examiner* — Bryon P Gehman
(74) *Attorney, Agent, or Firm* — Young & Thompson

(57) ABSTRACT

Disclosed is a device for transporting a biopharmaceutical fluid, including an inner bag forming an inner chamber adapted and intended for receiving a biopharmaceutical fluid, an outer container including an outer receptacle, the outer receptacle including a wall forming an outer chamber, an expandable protective element arranged at least partially between the outer receptacle and the inner bag and adapted to receive the inner bag, the expandable protective element being adapted to expand in volume to an expanded state so as to be interposed between the outer receptacle and the inner bag, the expandable protective element in the
(Continued)

expanded state surrounding the inner bag and filling the space between the wall of the outer receptacle and the inner bag.

29 Claims, 7 Drawing Sheets

(51) Int. Cl.

| | |
|---|---|
| ***A61J 1/05*** | (2006.01) |
| ***B65D 3/02*** | (2006.01) |
| ***B65D 35/08*** | (2006.01) |
| ***B65D 35/26*** | (2006.01) |
| ***B65D 35/28*** | (2006.01) |

(52) U.S. Cl.
CPC ..... *B65D 35/26* (2013.01); *B65D 35/28* (2013.01); *B65D 81/052* (2013.01); *B65D 2581/051* (2013.01)

(58) Field of Classification Search
CPC ..... B65D 35/08; B65D 35/26; B65D 35/28; B65D 77/06; B65D 81/05; B65D 81/052; B65D 2581/051
USPC ..... 206/522; 220/62.15–62.21, 220/592.21–592.26
See application file for complete search history.

(56) References Cited

U.S. PATENT DOCUMENTS

| | | | | |
|---|---|---|---|---|
| 5,843,049 | A * | 12/1998 | Heilmann | A61J 1/10 604/275 |
| 5,891,097 | A | 4/1999 | Saito et al. | |
| 5,950,833 | A * | 9/1999 | James | B65D 81/052 206/445 |
| 6,641,562 | B1 * | 11/2003 | Peterson | A61M 5/148 604/132 |
| 7,669,727 | B2 * | 3/2010 | Hubbard | B65D 77/06 206/522 |
| 2006/0272288 | A1 * | 12/2006 | Kannankeril | B65D 81/052 206/522 |
| 2007/0256904 | A1 * | 11/2007 | Ribaut | B65D 81/052 190/109 |
| 2013/0056480 | A1 * | 3/2013 | Calhau | B65D 81/051 220/592.26 |
| 2015/0151892 | A1 * | 6/2015 | Corten | B65D 77/065 366/273 |
| 2016/0015599 | A1 | 1/2016 | Gentile et al. | |

FOREIGN PATENT DOCUMENTS

| | | | |
|---|---|---|---|
| WO | 95/11838 | A1 | 5/1995 |
| WO | 2014/140494 | A1 | 9/2014 |

* cited by examiner

DEVICE FOR CONVEYING A BAG COMPRISING A BIOPHARMACEUTICAL FLUID AND SYSTEMS AND A METHOD USING SAME

FIELD OF THE INVENTION

The invention relates to the field of receiving, storing, and transporting biopharmaceutical fluid.

The invention relates more particularly to a device for storage and transport, in particular a device specifically intended for transport. The invention also relates to a system for receiving and transferring a biopharmaceutical fluid comprising such a device, and a method for receiving and transferring under controlled pressure a biopharmaceutical fluid wherein such a system is used.

The term "biopharmaceutical fluid" is understood to mean a product of biotechnology (culture media, cell cultures, buffer solutions, artificial nutrition liquids, blood products and derivatives of blood products) or a pharmaceutical product or more generally a product intended for use in the medical field. Such a product is in liquid, paste, or possibly powder form. The invention also applies to other products subject to similar requirements concerning their packaging.

BACKGROUND OF THE INVENTION

Flexible sterile bags intended for receiving a biopharmaceutical fluid are known. These flexible sterile bags are handled frequently in a large number of operations, for example during filling, freezing, storage, transport, thawing, draining, etc. In particular, during the transport phases, for example by boat, plane, or truck, there is a risk of the bag being damaged and its integrity compromised if it is not properly protected. Bag leakage can occur, resulting in a loss of the biopharmaceutical fluid it contains as well as a loss of sterility.

Also, in order to carry out the transport operations described above, it is known to use devices that allow receiving the bag containing the pharmaceutical fluid and then transporting it in a secure manner.

In a first known embodiment, a device comprises a rigid container in which is placed one or more bags filled with biopharmaceutical fluid. The device thus allows maintaining and protecting the bag or bags during transport. However, significant stresses can be generated in the bag, for example due to movement of the biopharmaceutical fluid inside it. In addition, when the bag comprises rigid elements such as ports or connectors for fill or discharge tubes, these can strike the inner wall of the container if there are impacts, vibrations, or turbulence during transport operations. This can exert significant mechanical stress at the wall of the bag, particularly at the sites for attachment of rigid tubing to the wall of the bag, which can be sufficient to rupture the bag or cause damage likely to compromise its integrity.

In a second embodiment, the device may further comprise bubble wrap and/or foam placed on the inner wall of the rigid container to prevent impacts between the bag and the container during transport. However, for cost reasons, it is often preferable to use containers of standard sizes for the transport of flexible bags of various sizes. Also, when the container is not of a size specifically adapted to that of the bag, free space remains between the inner wall of the container and the bag so that the bag is not properly held in place. This can occur as well when the container is adapted for a size of flexible bag having a certain predefined fill level but the bag is underfilled or overfilled relative to this predefined fill level. The bag is then able to move within the container under the effect of external stresses and can rupture when it strikes the container wall.

In a third embodiment, the device may consist of a protective shell in which the bag is suspended, thus distancing it from the inner wall of the shell. However, such a device is complex to implement because the shell must comprise internal means for suspending the bag. It is also necessary to ensure that no part of the bag is in contact with the shell, which can be tedious and time-consuming when the suspension of a large number of bags must be checked prior to transport.

There is therefore a need, in the specific field of the invention, to be able to transport bags of biopharmaceutical fluid easily and securely.

OBJECTS AND SUMMARY OF THE INVENTION

To resolve the stated problem, a first aspect of the invention relates to a device for transporting a biopharmaceutical fluid, comprising:

- an inner bag made of plastic, flexible and fluidtight, forming an inner chamber adapted and intended for receiving a biopharmaceutical fluid,
- an outer container comprising an outer receptacle, the outer receptacle comprising a wall forming an outer chamber in which is placed the inner bag,
- an expandable protective element arranged at least partially between the outer receptacle and the inner bag and adapted to receive the inner bag, the expandable protective element being adapted to expand in volume to an expanded state so as to be interposed between the outer receptacle and the inner bag,
- the expandable protective element surrounding the inner bag and filling the space between the wall of the outer receptacle and the inner bag when in the expanded state.

By means of this device, the bag can be held in place in the outer container and it is possible to better distribute the mechanical stresses the bag undergoes during its storage or transport within the container.

In various embodiments of the invention, one or more of the following arrangements may possibly be used, separately or in combination:

- the inner bag is provided with a wall and at least one orifice for the fill and/or discharge of biopharmaceutical fluid and a fill and/or discharge tube associated in a fluidtight manner with the fill and/or discharge orifice;
- the outer container primarily comprises, in particular consists of, the outer receptacle;
- the outer receptacle is a rigid or semi-rigid shell;
- the outer receptacle comprises a wall of parallelepipedic shape, the wall comprising a lower wall, an upper wall, and a peripheral side wall;
- the outer container, and in particular the outer receptacle, is of large capacity in order to receive multiple inner bags filled with biopharmaceutical fluid, the outer container being able to receive more than one inner bag, particularly more than five inner bags, more particularly more than ten inner bags;
- the outer receptacle comprises a single foldable wall adapted to form, when folded, an outer receptacle of parallelepipedic shape, the wall comprising at least a lower wall and a peripheral side wall;

the wall of the outer receptacle is at least partly, possibly entirely, translucent so as to allow viewing, through the wall, the expandable protective element and the inner bag;

the wall of the outer receptacle is at least partly, possibly entirely, opaque to light or to ultraviolet rays;

the outer receptacle comprises a first compartment and a second compartment, the first compartment being adapted and intended for receiving the wall, and in particular the two main wall portions, of the inner bag, the second compartment being adapted and intended for receiving the fill tube and the discharge tube of the inner bag;

the outer receptacle comprises a separation formed for example by a dividing partition, the separation defining the first compartment and the second compartment of the outer receptacle;

the expandable protective element comprises a flowable material, for example a foam, adapted to expand in volume to the expanded state;

the expansion of the expandable protective element is achieved by drying, heat treatment, chemical treatment, or irradiation;

the expandable protective element is inflatable, the expandable protective element being provided with an injection orifice, in other words a passage, for the injection of inflation gas, in fluid communication with the protective element, the injection orifice of the protective element being associated by a fluidtight connection with an injection tube having at the opposite end an inlet for the injection of inflation gas into the expandable protective element;

the expandable protective element comprises a wall, the wall comprising inflatable elements interconnected in fluid communication so as to form together a protective chamber, the inner bag being suitable for placement in the protective chamber;

the expandable protective element comprises a wall joined in a fluidtight manner, by welding or the like, to a common edge with the wall of the outer receptacle;

the inner bag is arranged in an individual expandable protective element;

the inflation gas injection orifice, in particular which is associated with an injection tube having an injection inlet, is formed in an exterior injection orifice of the wall of the outer receptacle;

when inflation gas is injected into the protective element, the protective element occupies the space between the inner bag and the outer receptacle so as to limit the ability of the inner bag to move within the outer receptacle;

the expandable protective element comprises at least a first portion and a second portion, the first portion substantially surrounding the wall of the inner bag, the second portion substantially surrounding the fill and/or discharge orifice of the inner bag as well as the fill and/or discharge tube;

the fill and/or discharge tube traverses the outer receptacle;

the expandable protective element is at least partly, possibly entirely, translucent or transparent so as to allow viewing the inner bag;

the expandable protective element is at least partly, possibly entirely, opaque to light or to ultraviolet rays;

the device comprises or is suitable for association with a discharge member adapted so that, at least during discharge, the discharge orifice is located in the lower portion of the inner bag, in particular the lowermost portion of the inner bag;

the discharge member comprises a member for inclining the device, in particular the outer receptacle, the inclining member having one or more legs, for example hinged, associated with the outer receptacle and resting on a horizontal support surface;

the discharge member adapted so that the discharge orifice is positioned in the lower portion of the inner bag comprises, in particular consists of, a portion of the wall of the expandable protective element; and the outer receptacle comprises a rigid inner wall which enables inclining the inner bag when said bag is arranged in the outer receptacle.

The invention also relates to a system for receiving and transferring under controlled pressure a biopharmaceutical fluid, comprising:

a device according to the invention, the protective element being provided with an orifice or inlet for the injection of inflation gas, the inner bag being provided with an orifice for filling with biopharmaceutical fluid and an orifice for discharging biopharmaceutical fluid, and, in fluidtight association with the fill orifice and the discharge orifice, a fill tube having an inlet for filling the chamber with biopharmaceutical fluid, adapted to be associated with a line for filling with biopharmaceutical fluid, and a discharge tube having a discharge outlet for draining biopharmaceutical fluid from the chamber, adapted to be associated with a fluid discharge line, a system for inflating the expandable protective element, comprising a member adapted and intended for supplying a pressurized inflation gas having a line for the injection of pressurized inflation gas, able to be associated in fluid communication or being associated in fluid communication with the orifice or inlet for the injection of pressurized inflation gas of the expandable protective element of the device, the system also comprising a member for controlling and managing the pressure of the pressurized inflation gas in the line for the injection of pressurized inflation gas, a fill line and a discharge line which are adapted to be associated in fluid communication or are associated in fluid communication at the outlet respectively of the fill orifice and the discharge orifice of the device.

The invention also relates to a method for receiving and transporting a biopharmaceutical fluid, wherein:

a device according to the invention is provided, the device then being in a state empty of biopharmaceutical fluid and of pressurized inflation gas, the outer receptacle being open, the inner bag is placed inside the protective element, the expandable protective element together with the inner bag are placed inside the receptacle, the inner chamber of the inner bag is filled with biopharmaceutical fluid via the fill orifice, the expandable protective element is filled with inflation gas, and the outer receptacle Is closed.

The invention also relates to a method for receiving and transporting a biopharmaceutical fluid, wherein:

a device according to the invention is provided, the device then being in a state empty of biopharmaceutical fluid and pressurized inflation gas, the outer receptacle being open, the expandable protective element is placed inside the receptacle, at least one end of the expandable protective element protruding beyond the outer receptacle, the inner bag is placed inside the receptacle on the protective element, the end of the expandable protective element then being folded over the inner bag so that the expandable protective element surrounds the inner bag, the inner chamber of the inner bag is filled with biopharmaceutical fluid via the fill orifice, the expandable protective element is filled with inflation gas, and the outer receptacle is closed.

The invention also relates to a method for receiving and transferring a biopharmaceutical fluid, wherein a system is provided for receiving and transferring under controlled pressure a biopharmaceutical fluid, and when one wishes to transfer under controlled pressure the biopharmaceutical fluid from the inner chamber, the line for the injection of pressurized inflation gas and the inlet for the injection of pressurized inflation gas of the protective element are placed in fluid communication, then the pressurized inflation gas is injected into the protective element so that the inner bag is compressed and the pressure drains the biopharmaceutical fluid therein.

In various embodiments of the method according to the invention, one and/or the other of the following arrangements may possibly be used, separately or in combination:

during discharge, the discharge orifice is positioned in the lower portion of the inner bag, in particular the lowermost portion of the inner bag;

the inflation gas is injected such that the pressure of the biopharmaceutical fluid in the discharge outlet remains substantially constant during the discharge.

BRIEF DESCRIPTION OF THE DRAWINGS

Several embodiments of the invention are now described with reference to the drawings, in which.

MORE DETAILED DESCRIPTION

Figure 1:
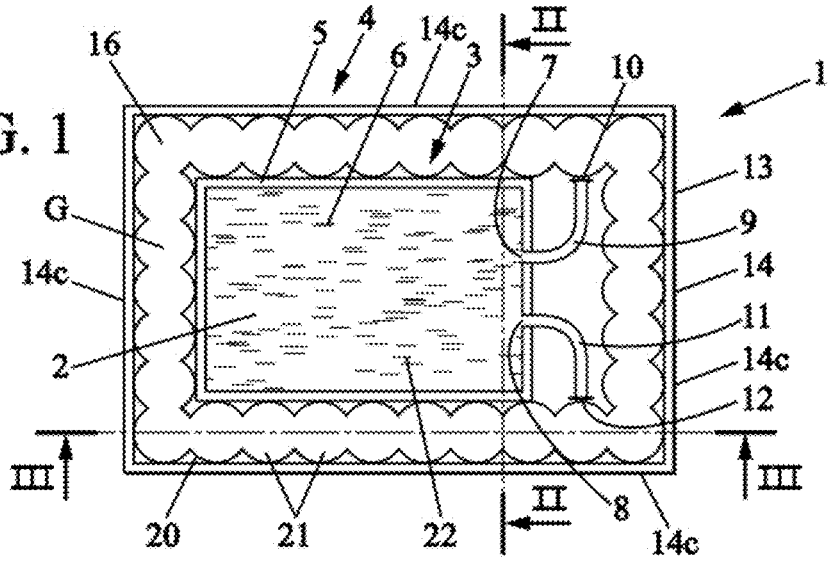
FIG. 1 is a schematic view of a device for receiving and transporting a biopharmaceutical fluid according to the invention, showing an inner bag, an outer container comprising an outer receptacle which by itself forms the container, and an inflatable protective element in the inflated state arranged between the inner bag and the outer container in which the inner bag is placed.

The following is a detailed description of several embodiments of the invention, accompanied with examples and with reference to the drawings. The invention is of course not limited to the embodiment(s) described, which are provided for the purposes of illustration, not limitation.

The invention relates to a device 1 for storing and transporting a biopharmaceutical fluid 2 (said device 1 being referred to below as "device").

The device 1 comprises an inner bag 3 and an outer container 4.

The inner bag 3 is flexible and fluidtight. The inner bag 3 is formed from a wall 5 made of plastic. The wall 5 forms and defines an inner chamber 6, which can be flat (FIG. 10A) or expanded in volume (FIGS. 10B and 10C for example) and which is adapted and intended for receiving biopharmaceutical fluid 2.

In the embodiments shown in FIGS. 1, 2, 3, 4, 7, 8, 9, and 10, the inner bag 3 is 2D, in other words two-dimensional, and has a wall 5 comprising two main wall portions 28, opposite one another, sealed together by welding or the like on a common peripheral side edge 30 which is also the peripheral side edge of the inner bag 3.

Figure 5:
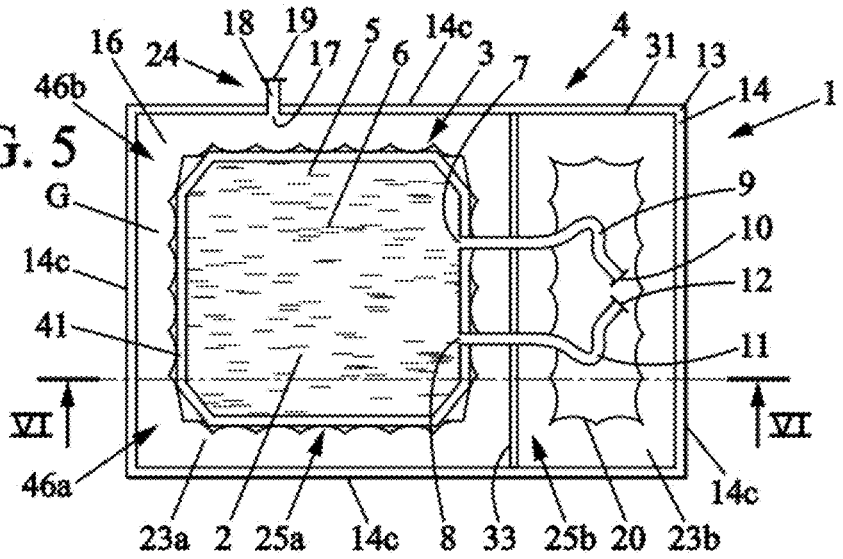
FIG. 5 is a schematic view of another embodiment of an inner bag and a receiving and transport device according to the invention.
Figure 6:
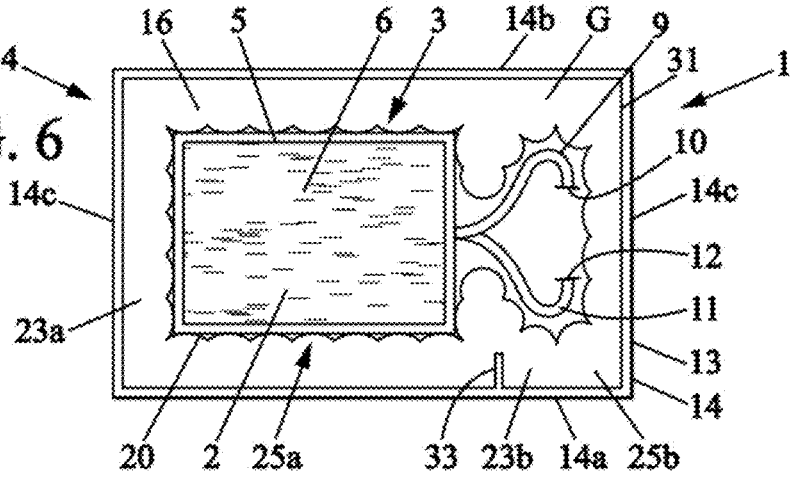
FIG. 6 is a sectional view along line VI-VI of the device of FIG. 5.
Figure 7:
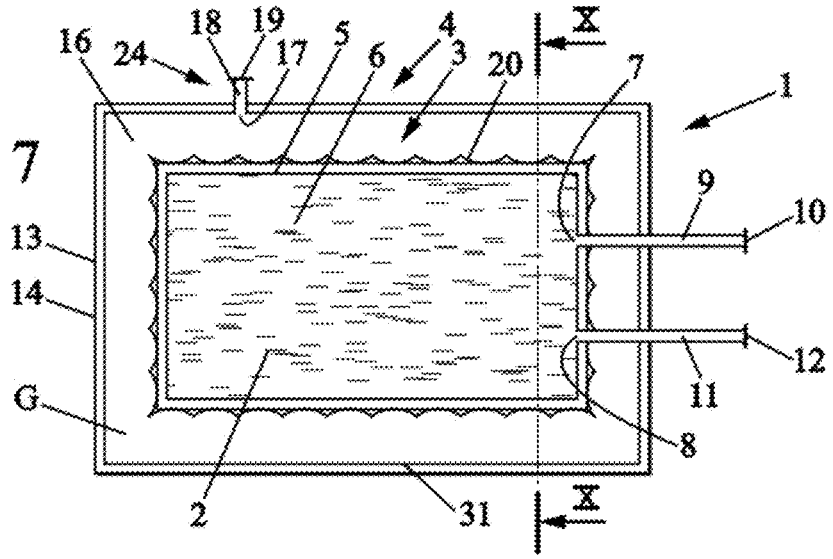
FIG. 7 is a schematic view of another embodiment of a receiving and transport device according to the invention.

As illustrated in FIGS. 5 and 6, the inner bag 3 may also be 3D, in other words three-dimensional, generally of parallelepipedic shape. The inner bag 3 then typically comprises a main wall 41 having two parts fixedly and sealingly connected at two side gussets 46*a*, 46*b* by fluidtight welds.

The deployed inner bag 3 has a capacity between 1 liter and 70 liters, in particular between 1 and 55 liters, depending on requirements and applications.

The inner bag 3 is provided with an orifice, meaning a passage 7 for filling with biopharmaceutical fluid 2, and an orifice, meaning a passage 8 for discharging biopharmaceutical fluid 2. In particular, the fill orifice 7 and the discharge orifice 8 are located adjacent to one another on the wall 5 of the inner bag 3 or at the common peripheral side edge 30.

The fill orifice 7 and the discharge orifice 8 of the inner bag 3 and of the wall 5 are respectively associated by fluidtight connections with a fill tube 9 having at the opposite end an inlet 10 for filling the inner chamber 6 with biopharmaceutical fluid 2 and a discharge tube 11 having at the opposite end an outlet 12 for draining the chamber 6 of biopharmaceutical fluid 2.

Alternatively, the inner bag 3 may comprise a single fill and discharge orifice. In this embodiment, a single tube acting as a tube for filling and discharging biopharmaceutical fluid in the chamber 6 is then associated by a fluidtight connection with the orifice of the inner bag 3. In yet another alternative, the inner bag 3 may comprise more than two fill and discharge orifices, and therefore more than two fill and/or discharge tubes.

"Fluidtight connection" is understood to mean a known structure, such that the wall 5 of the inner bag 3 and the tube 9, 11 in fluid communication with the orifice 7, 8 are associated with each other so as not to permit any passage at the connection between them, particularly of the biopharmaceutical fluid 2 or a gas or possible contaminants. The wall 5 of the inner bag 3 and the tubes 9, 11 may form a single inseparable whole or may be interconnected by systems of connectors.

"Tube" is understood to mean a hollow structure that is more or less long or short, the term also including a simple port.

The outer container 4 comprises at least an outer receptacle 13. The outer receptacle 13, made of plastic or other synthetic or metal material, may be formed from a wall 14 or even from a plurality of parts having the general form of solid or substantially solid panels which are flat or substantially flat, as well as connecting parts, reinforcing parts, accessories, etc.

As shown in the figures, the receptacle 13 may consist of a case or a rigid or semi-rigid shell. "Rigid or semi-rigid" is understood to mean that the outer receptacle 13 is of greater rigidity than the wall 5 of the inner bag 3.

More particularly, according to one configuration, the outer receptacle 13 has a parallelepipedic shape and the wall 14 comprises a lower wall 14*a*, an upper wall 14*b*, and a peripheral side wall 14*c* erected as four panels each pair being perpendicular or parallel to one another.

Under normal circumstances, the lower wall 14*a* and the upper wall 14*b* are arranged horizontally or substantially horizontally, while the peripheral side wall 14*c* is arranged vertically or substantially vertically, possibly flaring slightly outward from the transverse lower wall 14*a*. The description is given in reference to this situation. Also in reference to this situation are to be understood the words "horizontal," "vertical," "lower," and "upper".

Figure 12:
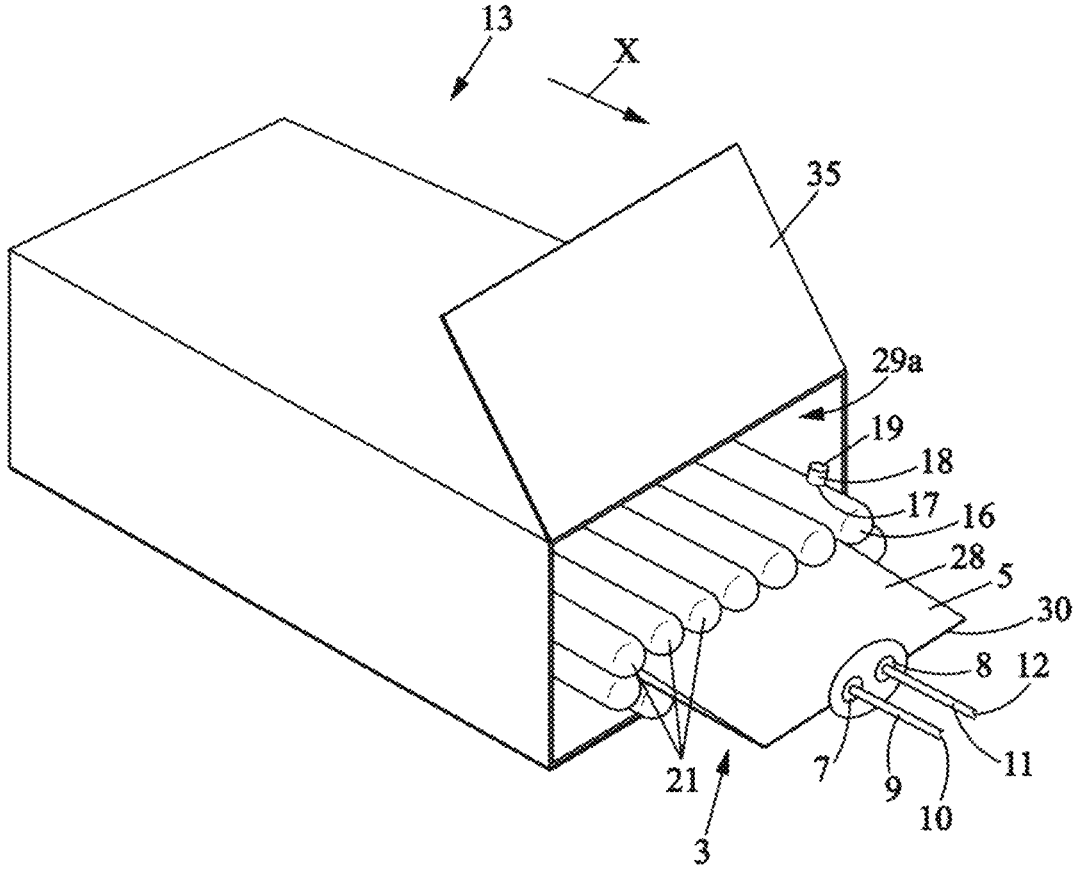
FIG. 12 is a perspective view of an inner bag within an inflatable protective element according to an embodiment of the invention, the bag and the inflatable protective element being partially inserted into an outer receptacle.
Figure 13A:
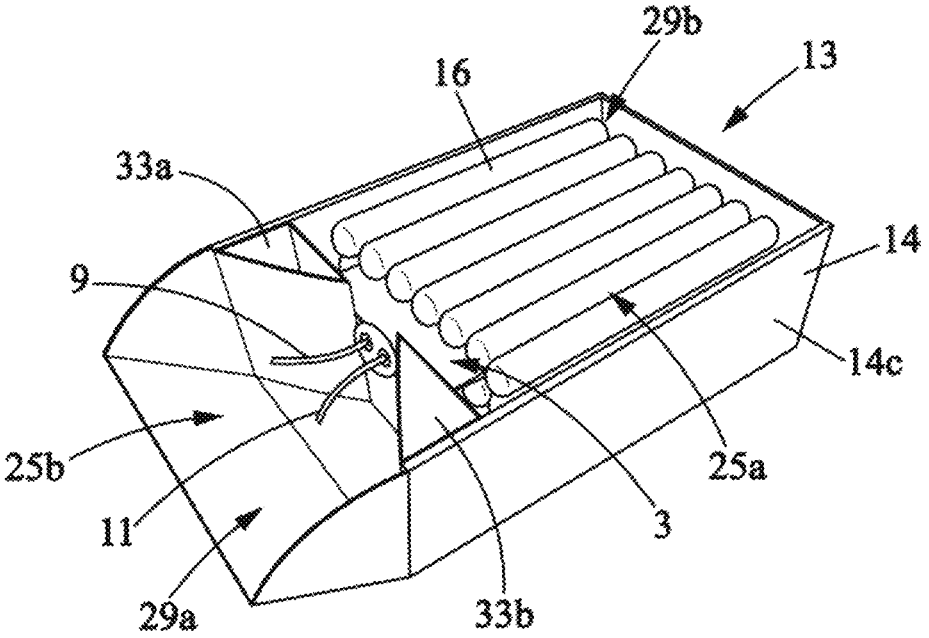
FIGS. 13A and 13B are respective perspective views of an inner bag and an inflatable protective element which are inserted into an outer receptacle according to another embodiment, the outer receptacle comprising a side panel in the open state and closed state respectively.
Figure 13B:
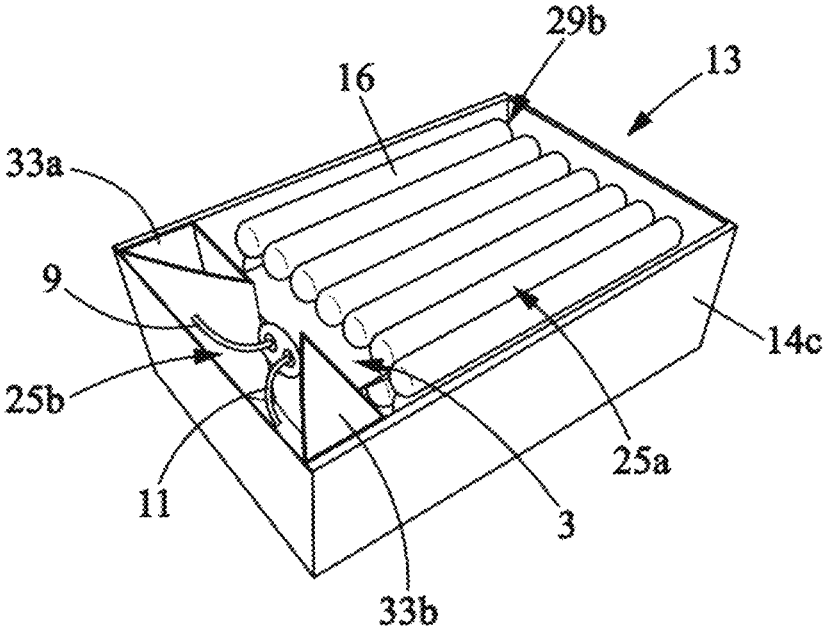

According to one embodiment illustrated by FIGS. 13A and 13B, the outer receptacle 13 comprises a single foldable wall 14, for example of cardboard, adapted to form an outer receptacle 13 of parallelepipedic shape when folded, the wall 14 then comprising at least a lower wall 14*a* and a peripheral side wall 14*c*. The wall 14 of the outer receptacle 13 thus forms an outer chamber 15. The peripheral side wall 14*c* may also comprise an opening 29*a* (FIGS. 12, 13A, and 13B) which can be selectively opened or closed, for example by a cover 35. In the embodiment illustrated in FIGS. 13A and 13B, the opening 29*a* is in one of the panels of the peripheral side wall 14*c* which may be either in a closed state or in an open state where the panel is tilted outwards from the receptacle 13. In this open state, it is thus possible to access the interior of the outer receptacle 13.

Moreover, according to this embodiment illustrated in FIGS. 13A and 13B, the upper wall 14*b* of the outer receptacle 13 is open, and may in particular comprise an opening 29*b*. According to this variant, a cover (not shown in FIGS. 13A and 13B) is used to close the upper wall 14*b* of the outer receptacle 13. The cover may be provided with gripping and handling members covering the opening 29*b*. Where appropriate, members are provided for quickly locking the cover in the closed position, hiding the opening 29*b*. Opening it thus allows access to the interior of the outer receptacle 13.

Alternatively, the outer receptacle 13 may comprise a single foldable wall 14 which when folded comprises, in addition to a lower wall 14*a* and a side wall 14*c*, also an upper wall 14*b*. In this variant, the upper wall 14*b* may be removable in order to be alternately closed or open.

The outer receptacle 13 of the outer container 4 is adapted and intended for receiving the inner bag 3 (and therefore the inner chamber 6) in its entirety. Thus, the inner bag 3 (and therefore the inner chamber 6) is placed completely within, in other words inside of, the outer receptacle 13 and outer chamber 15, or symmetrically the receptacle 13 is placed so as to surround the exterior of the inner bag 3 (and therefore the inner chamber 6).

As a result, the outer receptacle 13 is larger than the inner bag 3, or symmetrically the inner bag 3 is smaller than the receptacle 13. This is true whether the inner bag 3 is empty of biopharmaceutical fluid 2 or filled with biopharmaceutical fluid 2. The outer container 4, and in particular the outer receptacle 13, may in particular be of large capacity in order to be able to receive a large amount of inner bags 3 filled with biopharmaceutical fluid 2. According to this embodiment, the container 4 may receive more than one inner bag 3, particularly more than five inner bags 3, or more particularly more than ten inner bags 3.

The adjectives "inner" and "outer", respectively applied to the bag 3 and its constituent parts, to the container 4, and to the outer receptacle 13, reflect the fact that the receptacle 13 surrounds the exterior of the bag 3 placed completely within, in other words inside of, the receptacle 13. It is therefore in reference to this situation that the words "inner" and "outer" are to be understood.

In one embodiment, the outer receptacle 13 is at least partly transparent or translucent so as to allow viewing the inner bag 3 through its wall 14. In another embodiment, the receptacle 13 may also be at least partly, possibly entirely, opaque to light or to ultraviolet rays, for example to ensure optimal preservation of the biopharmaceutical product 2, particularly if the biopharmaceutical product 2 is a photosensitive product.

An expandable protective element 16 is arranged between the outer receptacle 13 of the outer container 4 and the inner bag 3. The expandable protective element 16 is able to be in two states, an expanded state and a non-expanded state.

In the expanded state, the expandable protective element 16 is expanded in volume. The inner bag 3 is then held in place in the outer receptacle 13, and the outer receptacle 13 is fully occupied by the protective element 16 and the inner bag 3. In particular, the expandable protective element 16 substantially surrounds the inner bag 3, meaning that the majority of the wall 5 of the inner bag 3 is in contact with the expandable protective element 16. In the non-expanded state, the protective element 16 is not expanded in volume, and the space within the outer receptacle 13 is at least partially unoccupied.

Once in the expanded state, the protective element 16 substantially fills the space between the inner bag 3 and the wall 14 of the receptacle 13. Thus, the expandable protective element 16 serves to maintain the inner bag 3 by compressing it, in particular in several directions, within the outer receptacle 13. It is further possible to eliminate concerns related to the dimensions of the inner bag 3 varying with the fill level of biopharmaceutical fluid 2, by adjusting the expansion of the expandable protective element 16.

Figure 10A:
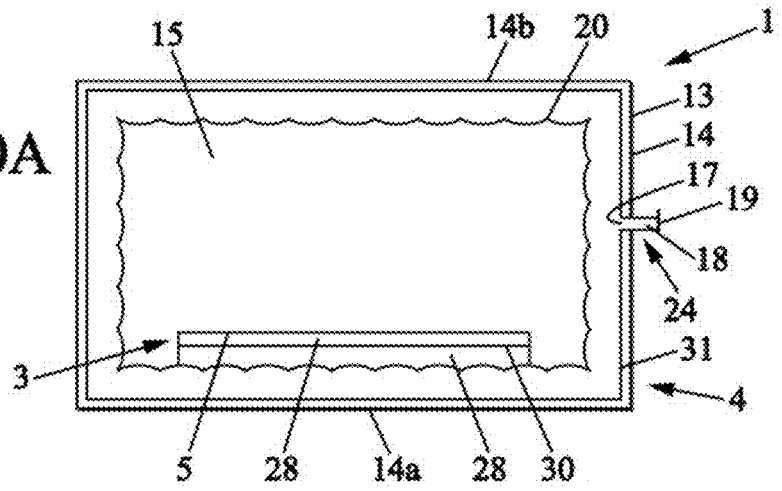
FIG. 10A is a sectional view along line X-X of the device of FIG. 7 when the inflatable protective element is uninflated and the inner bag is empty of biopharmaceutical fluid.

The device 1 comprising the inner bag 3 and the protective element 16 is adapted to be in two extreme states:

an empty state where the inner bag 3 is empty of biopharmaceutical fluid 2 and has a low internal volume, in particular as close to zero as its construction allows. The expandable protective element 16 is then in the non-expanded state. This empty state, as represented in FIG. 10A, is that of the device 1 before use or at the very beginning of its use, a filled state where the inner bag 3 is filled with biopharmaceutical fluid 2 so that the desired amount of biopharmaceutical fluid 2 fills the inner chamber 6. The expandable protective element 16 is then in the expanded state. This filled state is that of the device 1 during use, in particular when being transported.

Figure 10B:
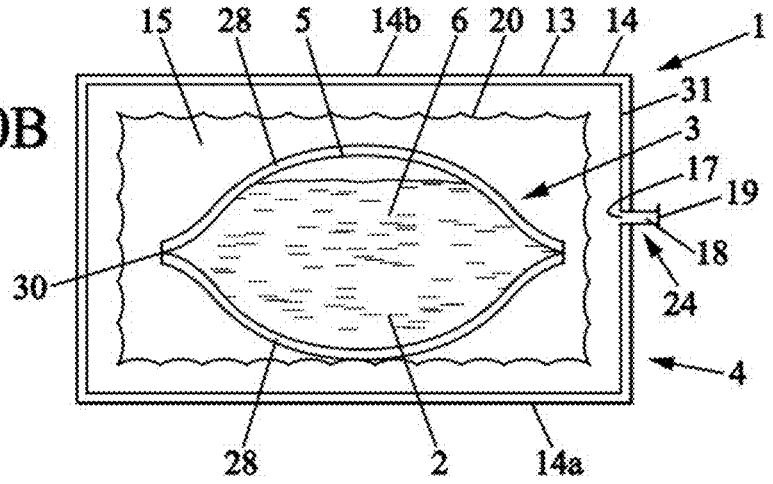
FIG. 10B is a sectional view along line X-X of the device of FIG. 7 when the inflatable protective element is uninflated and the inner bag is filled with biopharmaceutical fluid.
Figure 10C:
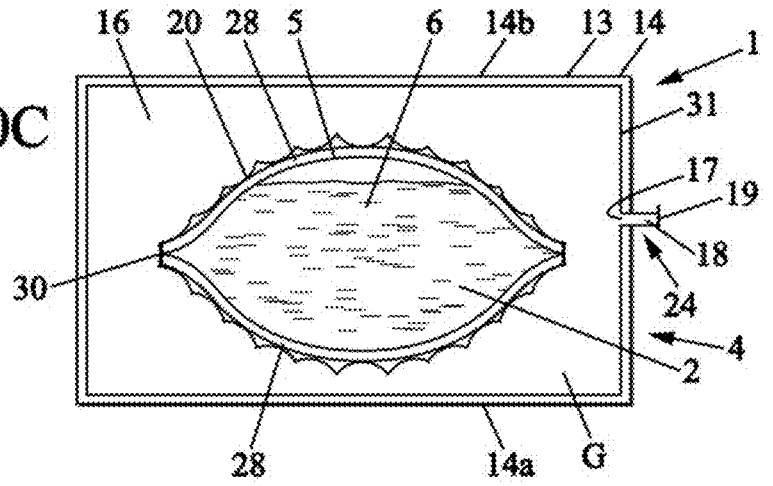
FIG. 10C is a sectional view along line X-X of the device of FIG. 7 when the inflatable protective element is inflated and the inner bag is filled with biopharmaceutical fluid.

As represented in FIG. 10B, it is also possible for the device 1 to be in an intermediate state in which the inner bag 3 is expanded in volume, being filled with biopharmaceutical fluid 2, but the expandable protective element 16 is in a non-expanded state. Conversely, it is also possible for the device 1 to be in an intermediate state in which the expandable protective element 16 is in the expanded state while the inner bag 3 is empty of biopharmaceutical fluid 2.

In addition, it should be understood that the outer receptacle 13 must always fulfill a function of containment and external retention of the inner bag 3 and the protective element 16, which requires that the expansion capacity of the outer receptacle 13, when the protective element 16 is in the expanded state, be limited, in particular very low. This can be achieved by choosing a rigid or semi-rigid wall 14 for the receptacle 13.

In a first embodiment, the expandable protective element 16 may comprise a flowable material, for example foam, adapted to expand in volume, particularly when subjected to certain conditions. For example, the expandable protective element 16 may be an expandable fluid which expands when dried, heat treated, chemically treated, or irradiated (a long as this method is compatible with the biopharmaceutical materials treated).

According to this first exemplary embodiment, the expandable protective element 16 may be introduced or injected by any means in the non-expanded state into the outer receptacle 13. In particular, the expandable protective element 16 may be introduced into the receptacle before the inner bag 3 has itself been placed in the outer receptacle 13. Alternatively, the expandable protective element 16 may be introduced into the outer receptacle 13 after the inner bag 3 has been placed in the outer receptacle 13, the inner bag 3 then able to be empty or already filled with biopharmaceutical fluid 2. An injection orifice 17 may be located directly on the wall 14 of the receptacle 13, for the purpose of introducing the expandable protective element into the outer receptacle 13.

The following more particularly describes a second exemplary embodiment of the expandable protective element 16 according to the invention as represented in FIGS. 1 to 13.

According to this second exemplary embodiment, the expandable protective element 16 is an inflatable protective element. The expandable protective element 16 may then be formed from a wall 20 made of plastic. Similarly to its wall 20, the expandable protective element 16 is flexible and fluidtight. The wall 20 of the protective element 16 forms and thus defines a protective chamber 22.

As represented by FIGS. 1 to 4 and 12, the inflatable protective element 16 may be a member separate and distinct from the outer receptacle 13. For example, the protective element 16 may consist of interconnected inflatable elements 21 in fluid communication so that together they form the protective chamber 22. These members 21 may for example be inflatable tubes or beads extending along an elongation axis X of the inner bag 3 (FIG. 12). However, these members 21 may have any other shape, for example the shape of cubes or spheres of various sizes. The protective element 16 is thus intended to receive at least one inner bag 3, for example a single inner bag 3. For example, the inner bag 3 may be inserted into the protective element 16, and in particular into the protective chamber 22, through a side of the inflatable protective element 16 that is left open. In this example, the protective element 16 may thus have a pass-through shape open at two opposite ends, or have the shape of a tank open at one end through which the inner bag 3 is inserted. By way of illustration, FIG. 12 shows an inner bag partially arranged within the protective chamber 22 of an inflatable protective element 16. Alternatively, the protective element 16 may comprise inflatable elements 21 forming a protective strip as will be described in more detail below.

Still according to this second embodiment, the inner bag 3 may be previously arranged within the inflatable protective element 16 in the protective chamber 22, said inflatable protective element 16 then surrounding substantially the entire wall 5 of the inner bag 3 and the tubing associated with the inner bag 3 such as the fill tube 9 and discharge tube 11. In particular, the inflatable protective element 16 surrounds the majority of the two main wall portions 28 of the inner bag 3. The inflatable protective element 16 also surrounds the wall portion 5 of the inner bag 3 comprising the fill orifice 7 and the discharge orifice 8.

Still according to this second embodiment in which the expandable protective element 16 is an inflatable protective element, the inflatable protective element 16 may comprise at least a first portion 23*a* and a second portion 23*b*. In particular, the first portion 23*a* substantially surrounds the inner bag 3, and in particular the two main wall portions 28 of the inner bag 3. The second portion 23*b* substantially surrounds the fill orifice 7 and the discharge orifice 8 of the inner bag 3 as well as the fill tube 9 and the discharge tube 11. The second portion 23*b* of the inner bag 3 is thus adapted to receive the tubing while the first portion 23*a* of the inner bag 3 is adapted to receive the two main wall portions 28, which are flexible and fluidtight. The first portion 23*a* and second portion 23*b* constitute two separate portions of the inflatable protective element 16 and can be interconnected and delineated by any means. In particular, the first portion 23*a* and second portion 23*b* may comprise only between them an opening adapted to allow the passage of the fill tube 9 and the discharge tube 11 from the first portion 23*a* to the second portion 23*b* of the protective element 16.

Alternatively, as represented for example in FIG. 5, the inflatable protective element 16 may be integral to the outer receptacle 13. For example, the protective element 16 may be fixed temporarily or permanently, for example glued or welded, to the wall 14 of the outer receptacle 13. In this embodiment, the inflatable protective element 16 may comprise a wall 20 joined in a fluidtight manner, by welding or the like, to a common edge 31 shared with the wall 14 of the outer receptacle 13. In this embodiment, the inflatable protective element 16, and in particular the wall 20, partially or completely covers the inside of the wall 14 of the outer receptacle 13.

The inflatable protective element 16 is adapted and intended to be inflated by pressurized inflation gas G, in particular by air or an inert gas. Thus, the protective element 16 may alternatively be in an expanded state in which it is inflated, or in a non-expanded state in which it is not inflated. Also, in the non-expanded state, the protective element 16 is flat, meaning that it is empty or substantially empty of inflation gas G to the extent that its construction allows.

The deformability of the inflatable protective element 16 then results firstly from the shape of the protective element 16, typically enabling the transition from an empty and flat shape (FIG. 10A) to an expanded shape (FIG. 10C) due to the inflation gas G. Secondly, this deformability can result from an intrinsic deformability of the walls 20 of the protective element 16, as they may have a certain capacity for enlargement, in particular elastically.

To fill the protective element 16 with inflation gas G, the protective element 16 is provided with an injection orifice 17, in other words a passage, for the injection of inflation gas G, in fluid communication with the protective element 16.

With the injection orifice 17 of the protective element 16 and the wall 20, there is associated by a fluidtight connection (this term is to be understood as explained above) an injection tube 18 (this term is to be understood as explained above) having at the opposite end an inlet 19 for the injection of inflation gas G into the protective element 16. Once the protective element 16 inflated by the inflation gas G, the injection orifice 17 or injection tube 18 may be sealed irreversibly, in particular by welding. Alternatively, the injection orifice 17 consists of a self-sealing valve. Such a valve makes it possible to seal the protective element 16 closed automatically once it is inflated.

Furthermore, the injection orifice 17, with the injection tube 18, may be arranged in, respectively may traverse, the wall 14 of the outer receptacle 13 with a fluidtight connection also formed on the wall 14. The passage of the injection tube 18 through the wall 14 allows inflating the protective element 16 with inflation gas G from outside the outer receptacle 13 and outer container 4, in particular after prior installation of the protective element 16 inside the outer receptacle 13. In addition, in the embodiment where the protective element 16 is integral to the wall 14 of the outer receptacle 13, the injection orifice 17 may be located directly on the wall 14 of the receptacle 13.

According to the first or second exemplary embodiment described above, the expandable protective element 16 is preferably at least partly, possibly entirely, transparent or translucent so as to allow viewing the inner bag 3 through it, and in particular through the wall 20. In another embodiment, the expandable protective element 16 may also be at least partly, possibly entirely, opaque to light or to ultraviolet rays, for example to ensure optimal preservation of the biopharmaceutical product 2, particularly if the biopharmaceutical product 2 is a photosensitive product.

A same outer receptacle 13 may be of large capacity in order to accommodate multiple inner bags 3, each arranged and protected in an individual protective element 16. The device 1 thus enables the transport, for example in bulk or in a disorganized manner, of a large number of inner bags 3.

In a first embodiment which may be illustrated by FIGS. 1 to 4, the outer container 4 comprises the outer receptacle 13. The outer receptacle 13 is more particularly a rigid body ensuring the function of external containment of the inner bag 3 and the protective element 16.

Figure 4:
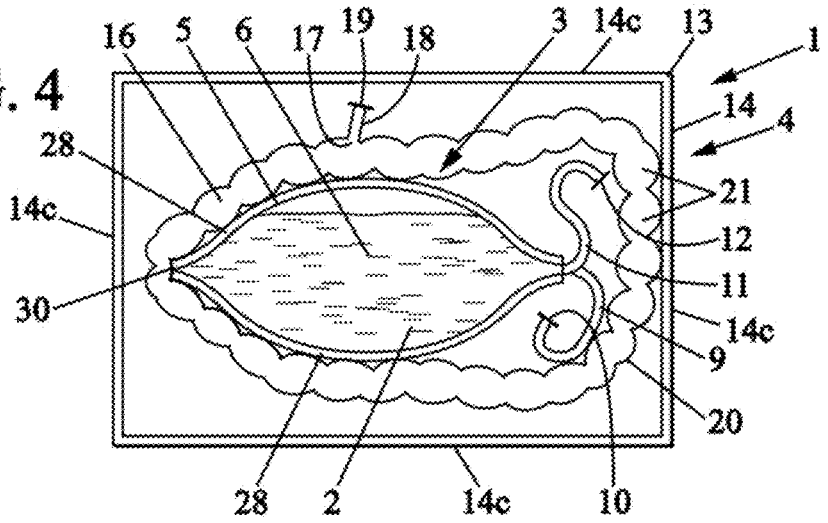
FIG. 4 is a schematic view of the device of FIGS. 1 to 3, where the inflatable protective element is in the uninflated state.

According to this embodiment, first the inner bag 3 empty of biopharmaceutical fluid 2 is placed inside the expandable protective element 16 which here is represented as an inflatable element. The expandable protective element 16 is thus in the non-expanded state, in particular uninflated, as is represented in FIG. 4.

Then the expandable protective element 16 together with the inner bag 3 is placed within the receptacle 13. In particular, the outer receptacle 13 may comprise a removable wall such as for example an opening 29*a*, 29*b*, which can be opened to allow introducing the inner bag 3 into the outer chamber 15 formed by the outer receptacle 13 and the wall 14.

Alternatively, when the protective element 16 forms a protective strip, the protective element 16 may be arranged in the outer receptacle 13 before the inner bag 3. The protective element 16 then comprises at least one end, in particular two ends, projecting beyond the outer receptacle 13. The inner bag 3 is then itself arranged in the outer receptacle 13, in particular on the protective element 16. The end of the protective element 16, in particular the two ends, can then be folded over the upper portion of the inner bag 3 so that the protective element 16 surrounds the inner bag 3.

Next, the inner bag is filled with biopharmaceutical fluid 2. In the configuration where the expandable protective element 16 is an inflatable element, the expandable protective element 16 is then filled with inflation gas G. The inflation gas G may in particular be injected from the outside through the injection orifice 17.

Figure 2:
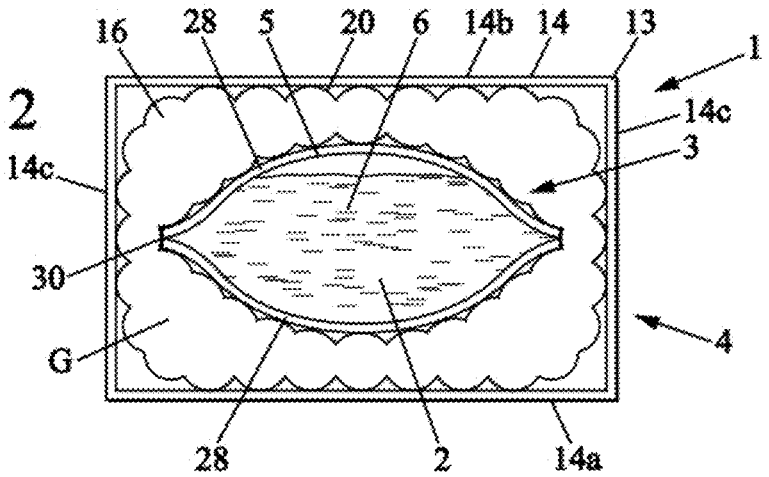
FIG. 2 is a sectional view along line II-II of the device of FIG. 1.
Figure 3:
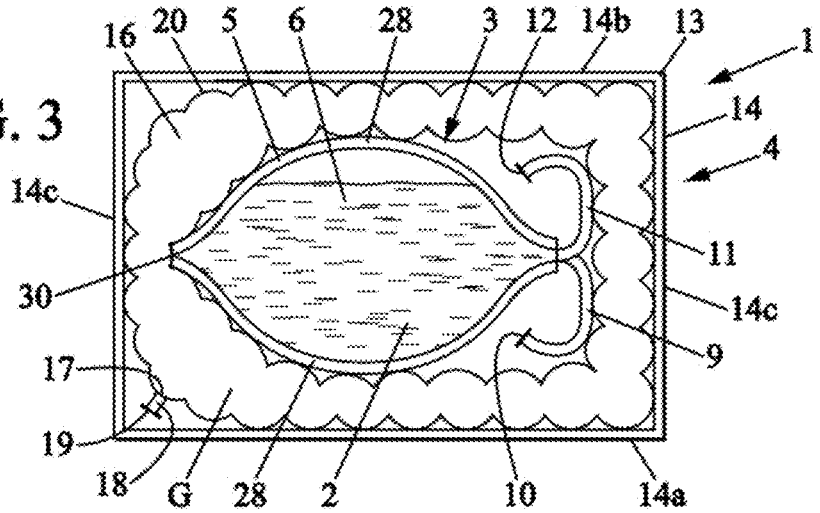
FIG. 3 is a sectional view along line III-III of the device of FIG. 1.

When the expandable protective element 16 is in the expanded state, and is in particular filled with inflation gas G as represented in FIGS. 1 to 3, the inner bag 3 is not in contact with or close to the outer receptacle 13, the inflation gas G then completely surrounding the inner bag 3. More specifically, the wall 5 of the inner bag 3 and the wall 14 of outer receptacle 13 are spaced apart from each other along all or substantially all their perimeter.

The opening 29*a*, 29*b* of the outer receptacle 13 is then closed so that the outer receptacle 13 defines an outer chamber 15 which is at least closed, if necessary in a fluidtight manner. By closing the wall 14, the outer receptacle 13 slightly compresses the protective element 16 and the inner bag 3 so as to ensure satisfactory retention of the inner bag 3 in the outer receptacle 13.

In a second embodiment which may be illustrated by FIGS. 5 and 6, the outer receptacle 13 may further comprise a separation 33 formed by a dividing partition. The dividing partition 33 may in particular have a variable height. The dividing partition 33 could also extend entirely between opposite side walls 14*c* of the outer receptacle 13 and have one or more openings. Alternatively, as illustrated in FIGS. 13A and 13B, the separation 33 may comprise two partitions 33*a*, 33*b* defining a central opening between them. In particular, the separation 33 defines a first compartment 25*a* of the outer receptacle 13 in which the wall 5 of the inner bag 3, and in particular the two main portions 28 of the wall 5 of the inner bag 3, is located when introduced into the outer receptacle 13. The separation 33 also defines a second compartment 25*b* in which the tubes or tubing associated with the inner bag 3, such as the fill tube and discharge tube 9, 11, are located when the inner bag 3 is introduced into the outer receptacle 13.

According to this second embodiment, the tubes 9, 11 are thus located in a space separate from the flexible wall 5 of the inner bag 3 during transport. It is thus possible in particular to prevent the tubes 9, 11 from coming into contact with, for example bumping or rubbing against, the wall 5 of the inner bag 3 during transport of the inner bag 3. The tubes 9, 11 are also retained in the second compartment 25*b*, to prevent their exposure to bending or twisting forces which could compromise their integrity.

Figure 8:
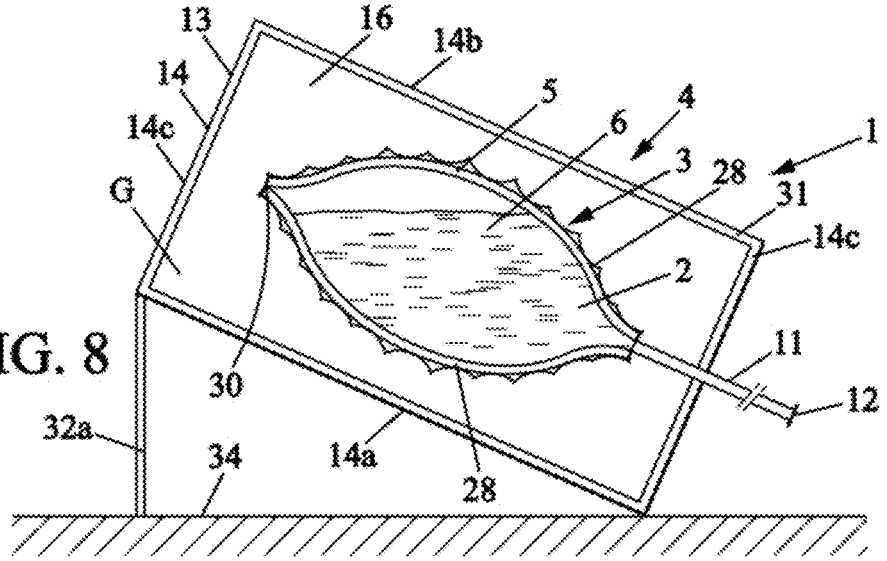
FIG. 8 is a schematic view of another embodiment of a receiving and transport device according to the invention.
Figure 9:
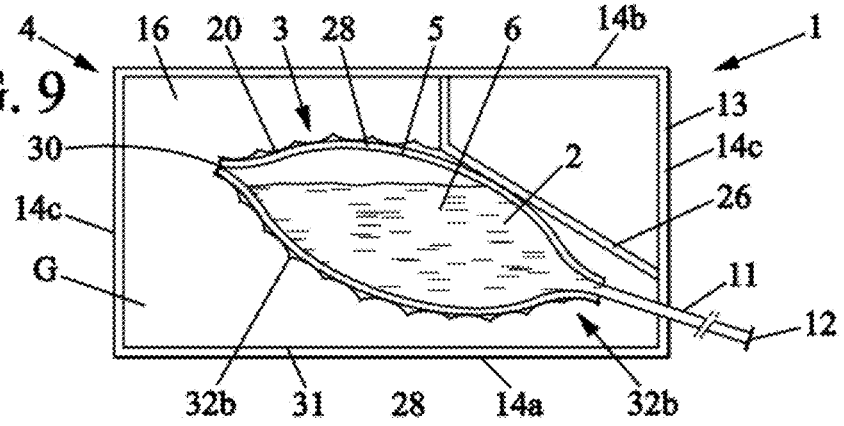
FIG. 9 is a schematic view of another embodiment of a receiving and transport device according to the invention.

According to a third embodiment which may be illustrated by FIGS. 8 and 9, the invention may also relate to a device for draining the inner bag 3 when said bag is positioned in the outer receptacle 13.

To this end, in this third embodiment the fill inlet 10 and the discharge outlet 12 associated with the inner bag 3 are located outside the outer receptacle 13, so as to be easily accessible.

In addition, the inner bag 3 is distanced from the outer receptacle 13 so as not to hinder the passage of biopharmaceutical fluid 2 to the orifices 7 and 8. These structural arrangements contribute to the effectiveness and efficiency of the device 1 when emptying the inner bag 3.

The device 1 is arranged so that, when the expandable protective element 16 is introduced, and in particular when pressurized inflation gas G is injected into the compression chamber 16 in the case where the expandable protective element 16 is inflatable, the inner bag 3 can be compressed so that the biopharmaceutical fluid 2 therein is emptied through the discharge outlet 12 due to the pressure.

According to this embodiment, the device 1 is such that it comprises or is able to be associated with a discharge member. The discharge member is itself adapted so that, at least when discharging the biopharmaceutical fluid 2, the discharge orifice 8 is located in the lower portion of the inner bag 3 and of the inner chamber 6 and, in particular, the lowermost portion. This is intended to facilitate draining the inner bag 3 and to ensure that, for safety reasons, the air in the upper portion of the inner bag 3 and inner chamber 6 cannot exit through the discharge orifice 8.

According to one possible embodiment illustrated in FIG. 8, the discharge member may be a member 32*a* for inclining the device 1, in particular the outer receptacle 13. This inclining member 32*a* may have one or more legs, for example hinged, associated with the bottom wall 14*a* of the outer receptacle 13 and at the opposite end resting on a horizontal support surface 34. The device 1 can thus be arranged at an incline on the horizontal support surface 34, with the discharge orifice 8 downward.

Alternatively, the discharge member 32 could also be a suspension element for the device 1, located opposite the discharge orifice 8, such as a suspension eyelet (not shown) provided in the upper portion of the outer receptacle 13, or possibly in the upper portion of the inner bag 3 when these are inclined. The device 1 can thus be arranged vertically with the discharge orifice 8 downward.

As illustrated by FIG. 9, the discharge member 32 could also consist of an inclined portion 32*b* of the wall 20 of the expandable protective element 16, the space between the inner bag 3 and the wall 14 of the receptacle 13 being locally increased in order to create this inclined portion 32*b* when the protective element 16 is in the expanded state. The receptacle 13 may also comprise a rigid inner wall 26 which inclines the inner bag 3 when the bag is placed in the outer receptacle 13. Thus the device 1, in particular the outer container 4, can be arranged horizontally with the inner bag 3 inclined with the discharge orifice 8 downward.

These embodiments of the discharge member 32*a*, 32*b*, suitable for ensuring that at least when discharging the biopharmaceutical fluid 2, the discharge orifice 8 is located in the lower portion, in particular the lowermost portion, of the inner bag 3, do not exclude other embodiments.

It is understood that the terms "downward" and "upward", "lower" and "upper" as applied to the inner bag 3, the expandable protective means 16, the container 4, and the receptacle 13, are understood to have their usual meaning and are in relation to the device 1 when arranged for discharging the biopharmaceutical fluid 2 by gravity.

It is possible to empty an inner bag 3, such as the one described, of the quantity of biopharmaceutical fluid 2 in its chamber 6 by compressing it, with no need to provide a pump, such as a peristaltic pump, associated with the discharge tube 11 or the discharge outlet 12. In particular, when the protective element 16 is an inflatable element, the inflation gas G can be injected so that the pressure of the biopharmaceutical fluid 2 in the discharge outlet 12 remains substantially constant during the discharge.

According to one configuration, a head loss-inducing element 36 such as a filter may also be associated with the discharge tube 11 or the discharge outlet 12.

The invention also relates to a system 40 for receiving and transferring under controlled pressure a biopharmaceutical fluid 2, comprising the device 1 and a method for receiving and transferring under controlled pressure a biopharmaceutical fluid 2 wherein the system 40 is provided and used.

Figure 11:
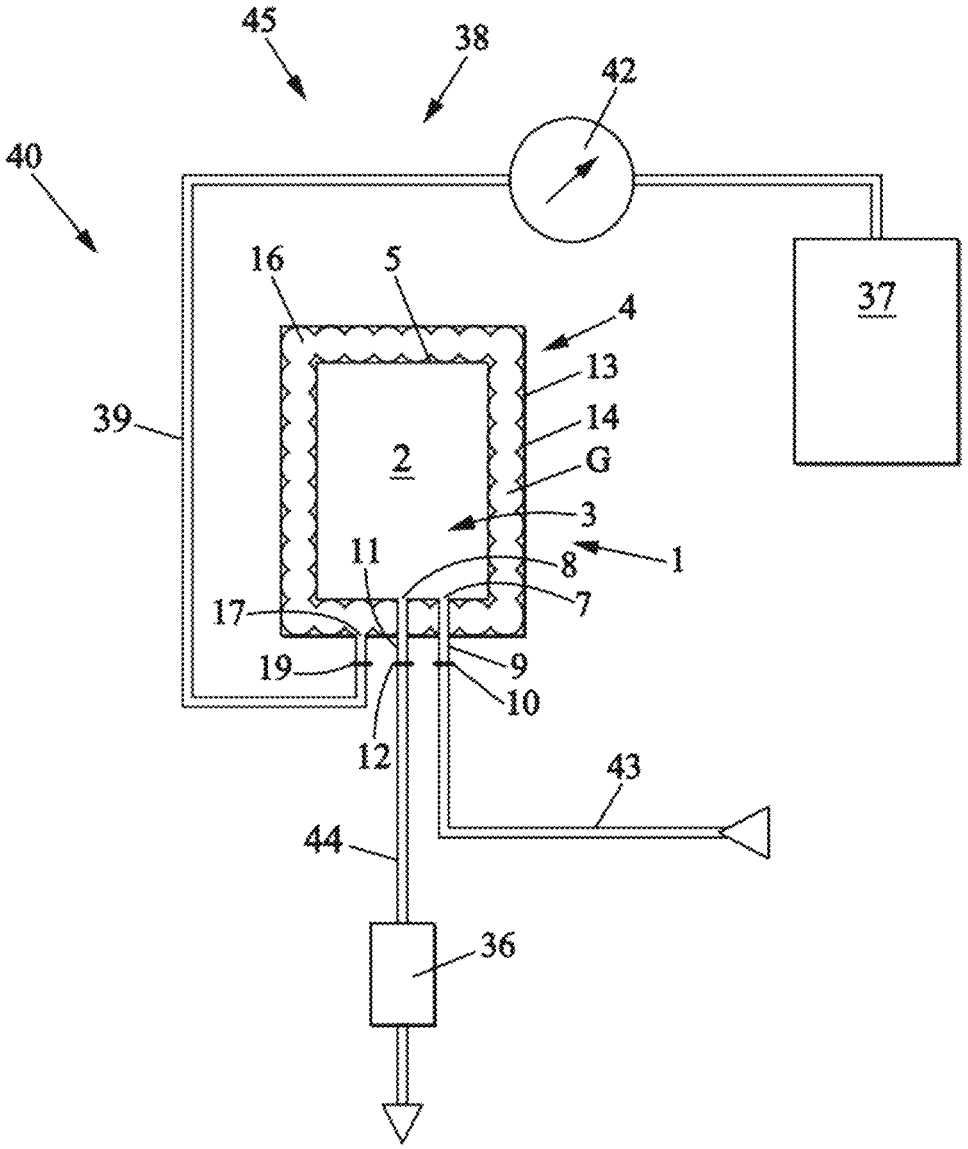
FIG. 11 is a view of a system for receiving and transferring under controlled pressure a biopharmaceutical fluid, comprising a device as previously shown.

As represented in FIG. 11, the system 40 for receiving and transferring under controlled pressure a biopharmaceutical fluid 2 may first comprise a system 45 for introducing, and in particular inflating, an expandable protective element 16 in the outer receptacle 13. The system 40 comprises the device 1 for receiving and then transporting a biopharmaceutical fluid 2 as described above, in particular a device 1 according to the embodiments described in FIGS. 7 to 9.

The system 45 then comprises a member 38 suitable for delivering the expandable protective element 16 or the pressurized inflation gas G when said member is an inflatable element. According to this embodiment, the system 45 comprises a source 37 of pressurized inflation gas G and a line 39 for the injection of pressurized inflation gas G, able to be associated in fluid communication or being associated in fluid communication with the outlet of the pressurized inflation gas G injection orifice 17 of the device 1.

The system 45 also comprises a control and management member 42. The control and management member 42 may for example be a pressure controller for the pressurized inflation gas G in the injection line 39, ordering the injection of inflation gas G when desired and controlling the injection at the desired pressure. Such a member 42 may be a pressure gauge, an adjustable valve, and/or a control line between them.

If the expandable protective element 16 is an inflatable element, the pressurized inflation gas G is supplied at a pressure at least equal to 100 mbar and at most equal to 1500 mbar. More particularly, and depending on requirements, this pressure is at least equal to 1000 mbar, more particularly at least equal to 700 mbar.

The system 40 for receiving and transferring under controlled pressure a biopharmaceutical fluid 2 also comprises, or there is associated with the system 40, a fill line 43 and a discharge line 44 which are adapted to be associated in fluid communication or are associated in fluid communication with the outlet respectively of the fill orifice 7 and the discharge orifice 8 of the device 1.

The method for receiving, transporting, and transferring under controlled pressure a biopharmaceutical fluid 2 according to the invention is such that a system 40 as described is initially provided in the state empty of biopharmaceutical fluid 2. The inner bag 3 is then placed in the outer receptacle 13, the expandable protective element 16 in the non-expanded state then being arranged between the inner bag 3 and the outer receptacle 13. Alternatively, the inner bag 3 may be placed in the outer receptacle 13, without the outer receptacle 13 initially comprising the expandable protective element 16. Also provided is the biopharmaceutical fluid 2 to be received and transferred under controlled pressure. Also provided is the member 38 adapted and intended for delivering the expandable protective element 16 or the pressurized inflation gas G.

When one wishes to receive biopharmaceutical fluid 2 in the device 1, one may first purge the gas from the fill line 43. Then the inner chamber 6 of the inner bag 3 is filled with biopharmaceutical fluid 2 via the fill inlet 10, in particular through the opening 29 of the outer receptacle 13, and then the fill inlet 10 is placed in the closed state, the discharge outlet 12 also being in the closed state.

Next, the protective element 16 is introduced or the protective element 16 is inflated, the fill inlet 10 and the discharge outlet 12 being in the closed state. In particular, in order to inflate the protective element 16, the line 39 for injecting pressurized inflation gas G and the inlet 19 for injecting pressurized inflation gas G of the outer receptacle 13 are placed in fluid communication. Alternatively, in the embodiment wherein the expandable protective element 16 is not initially comprised in the outer receptacle 13, the expandable protective element in the non-expanded state is introduced into the outer receptacle 13 via the injection line 39. As specified above, the expandable protective element 16 can then transition from the non-expanded state to the expanded state, for example when it is subjected to heat treatment.

The device 1 can then be detached from the system 40 so that the device 1 can be used to transport the inner bag 3 after the protective element 16 is in the expanded state as described above. In particular, the device 1 can be loaded onto a ship, truck, or aircraft in order to transport the inner bag 3.

After transport, when one wishes to transfer under controlled pressure the biopharmaceutical fluid 2 from the inner chamber 6 of the inner bag 3, the inner bag 3 can be compressed by further increasing the expansion of the expandable protective element 16. In particular, in the case where the expandable protective element 16 is an inflatable element, the line 39 for the injection of pressurized inflation gas G of the system 40 and the inlet 19 for injecting pressurized inflation gas G of the outer receptacle 13 are placed in fluid communication, in particular by means of the opening 29*a*, 29*b* of the outer receptacle 13, and the discharge outlet 12 is placed in the open state. Then the pressurized inflation gas G is injected into the inflatable protective element 16 between the outer receptacle 13 and the inner bag 3, so as to compress the inner bag 3 and empty it of the biopharmaceutical fluid 2 therein due to this pressure.

A head loss-inducing element such as a filter 36 may be placed in fluid communication with the discharge tube 11 or the discharge outlet 12. Also, when draining, the discharge orifice 8 may be positioned in the lower portion, in particular the lowermost portion, of the inner bag 3, with the aid of the discharge member 32 adapted for this purpose.

One can thus empty the inner bag 3 of all the biopharmaceutical fluid 2. Once the transfer under controlled pressure of the biopharmaceutical fluid 2 is complete, the inner bag 3 and the protective element 16 may be removed from the outer receptacle 13. The inner bag 3, the protective element 16, and the container 4 may be discarded, as they are disposable. Alternatively, the protective element 16 and the container 4 may be reused for the future transport of other bags.

The method described above may be carried out only in part, as the steps described above can be performed independently from each other. In particular, the inner bag 3 can be arranged in the outer receptacle 13 when it is already filled with biopharmaceutical fluid 2. Similarly, the protective element 16 could also be arranged in the outer receptacle 13 when it is already in the expanded state, and in particular in the inflated state. According to this alternative, one may then carry out only the emptying step of the method with the system 40. According to another alternative, one may carry out only the receiving of biopharmaceutical fluid 2 according to the method with the system 40, and not carry out the emptying step as indicated above.

Of course, the invention is not limited to the embodiments described above and provided only as examples. It encompasses the various modifications, alternative forms, and other variants conceivable to a skilled person within the context of the invention, and in particular any combinations of the various modes of operation described above, which may be taken separately or in combination.

The invention claimed is:

1. A device for storing and transporting a biopharmaceutical fluid, comprising:

an inner bag made of plastic, flexible and fluidtight, the inner bag forming an inner chamber adapted and intended for receiving a biopharmaceutical fluid, the inner bag being provided with a wall and one orifice for at least one of fill and discharge of biopharmaceutical fluid and at least one of a fill tube and a discharge tube associated in a fluidtight manner with the at least one of fill and discharge orifice, an outer container comprising an outer receptacle, the outer receptacle comprising a wall forming an outer chamber, both the entire inner bag and the at least one of a fill tube and a discharge tube being located entirely in the outer chamber of the outer container, an expandable protective element arranged at least partially between the outer receptacle and the inner bag and adapted to receive the inner bag, the expandable protective element being adapted to expand in volume to an expanded state so as to be interposed between the outer receptacle and the inner bag, wherein the expandable protective element in the expanded state surrounds the inner bag and fills the space between the wall of the outer receptacle and the inner bag.

2. The device according to claim 1, wherein the outer container consists of the outer receptacle.

3. The device according to claim 1, wherein the outer receptacle comprises a single foldable wall adapted to form, when folded, the outer receptacle being of a parallelepipedic shape, the outer receptacle comprising a lower wall and a peripheral side wall.

4. The device according to claim 1, wherein the outer container is of large capacity in order to receive multiple inner bags filled with biopharmaceutical fluid.

5. The device according to claim 1, wherein the wall of the outer receptacle is partly or entirely translucent so as to allow viewing, through the wall, the expandable protective element and the inner bag.

6. The device according to claim 1, wherein the wall of the outer receptacle is partly or entirely opaque to light or to ultraviolet rays.

7. The device according to claim 1, wherein the outer receptacle comprises a first compartment and a second compartment, the first compartment being adapted and intended for receiving the wall of the inner bag, the second compartment being adapted and intended for receiving the at least one of a fill tube and a discharge tube of the inner bag.

8. The device according to claim 7, wherein the outer receptacle comprises a separation, the separation defining the first compartment and the second compartment of the outer receptacle.

9. The device according to claim 1, wherein the expandable protective element comprises a flowable material adapted to expand in volume to the expanded state.

10. The device according to claim 1, wherein the expandable protective element is inflatable, the expandable protective element being provided with an injection orifice providing a passage for injection of inflation gas, the injection orifice being in fluid communication with the protective element, the injection orifice associated by a fluidtight connection with a first end of an injection tube, the injection tube having at an opposite second end an inlet for the injection of inflation gas into the expandable protective element.

11. The device according to claim 10, wherein the expandable protective element comprises a wall, the wall comprising inflatable elements interconnected in fluid communication so as to form together a protective chamber, the inner bag being suitable for placement in the protective chamber.

12. The device according to claim 10, wherein the inner bag is arranged in an individual expandable protective element.

13. The device according to claim 10, wherein the orifice for the injection of inflation gas is formed in an exterior injection orifice of the wall of the outer receptacle.

14. The device according to claim 10, wherein, when inflation gas is injected into the protective element, the protective element occupies the space between the inner bag and the outer receptacle so as to limit the ability of the inner bag to move within the outer receptacle.

15. The device according to claim 1, wherein the expandable protective element comprises a first portion and a second portion, the first portion surrounding the wall of the inner bag, the second portion surrounding the at least one of fill and discharge orifice of the inner bag as well as the at least one of a fill tube and a discharge tube.

16. The device according to claim 1, wherein the at least one of a fill tube and a discharge tube traverses the outer receptacle.

17. The device according to claim 1, wherein the expandable protective element is partly or entirely, translucent or transparent so as to allow viewing the inner bag.

18. The device according to claim 1, wherein the expandable protective element is partly or possibly entirely, opaque to light or to ultraviolet rays.

19. The device according to claim 1, wherein the one orifice for at least one of fill and discharge of biopharmaceutical fluid includes a discharge orifice for association with a discharge member adapted so that the discharge orifice is located in a lower portion of the inner bag.

20. The device according to claim 19, wherein the discharge member comprises a member for inclining the device, the inclining member having one or more legs associated with the outer receptacle and resting on a horizontal support surface.

21. The device according to claim 19, wherein said discharge member adapted so that the discharge orifice is positioned in the lower portion of the inner bag comprises a portion of the wall of the expandable protective element.

22. The device according to claim 1, wherein the outer receptacle comprises a rigid inner wall which enables inclining the inner bag when said bag is arranged in the outer receptacle.

23. A method for receiving and transporting a biopharmaceutical fluid, wherein a device according to claim 10 is provided, the inner bag having a wall and one orifice for at least one filling with and discharging biopharmaceutical fluid and the at least one of a fill tube and a discharge tube associated in a fluidtight manner with the at least one of fill and discharge orifice, the device then being in a state empty of biopharmaceutical fluid and of pressurized inflation gas, the outer receptacle being open, the inner bag is placed inside the protective element, the expandable protective element together with the inner bag are placed inside the receptacle, the inner chamber of the inner bag is filled with biopharmaceutical fluid via the fill orifice, the expandable protective element is filled with inflation gas, and the outer receptacle is closed.

24. A method for receiving and transporting a biopharmaceutical fluid, wherein:

a device according to claim 10 is provided, the inner bag having a wall and one orifice for filling with biopharmaceutical fluid and a fill tube associated in a fluidtight manner with the fill orifice, the device then being in a state empty of biopharmaceutical fluid and of pressurized inflation gas, the outer receptacle being open, the expandable protective element is placed inside the receptacle, one end of the expandable protective element protruding beyond the outer receptacle, the inner bag is placed inside the receptacle on the protective element, the end of the expandable protective element then being folded over the inner bag so that the expandable protective element surrounds the inner bag, the inner chamber of the inner bag is filled with biopharmaceutical fluid via the fill orifice, the expandable protective element is filled with inflation gas, and the outer receptacle is closed.

25. A device for storing and transporting a biopharmaceutical fluid, comprising:

an inner bag made of plastic, flexible and fluidtight, the inner bag forming an inner chamber adapted and intended for receiving a biopharmaceutical fluid, the inner bag being provided with a wall and one orifice for at least one of fill and discharge of biopharmaceutical fluid and at least one of a fill tube and a discharge tube associated in a fluidtight manner with the at least one of fill and discharge orifice, an outer container comprising an outer receptacle, the outer receptacle comprising a wall forming an outer chamber, the entire inner bag being placed in the outer chamber of the outer container, an expandable protective element arranged at least partially between the outer receptacle and the inner bag and adapted to receive the inner bag, the expandable protective element being adapted to expand in volume to an expanded state so as to be interposed between the outer receptacle and the inner bag, wherein the expandable protective element in the expanded state surrounds the inner bag and fills the space between the wall of the outer receptacle and the inner bag, wherein the expandable protective element is inflatable, the expandable protective element being provided with an injection orifice providing a passage for injection of inflation gas, the injection orifice being in fluid communication with the protective element, the injection orifice associated by a fluidtight connection with a first end of an injection tube, the injection tube having at an opposite second end an inlet for the injection of inflation gas into the expandable protective element, wherein the expandable protective element comprises a wall joined in a fluidtight manner to a common edge with the wall of the outer receptacle.

26. A system for receiving and transferring under controlled pressure a biopharmaceutical fluid, comprising:

a device for storing and transporting a biopharmaceutical fluid, comprising: an inner bag made of plastic, flexible and fluidtight, the inner bag forming an inner chamber adapted and intended for receiving a biopharmaceutical fluid, the inner bag being provided with a wall and one orifice for at least one of fill and discharge of biopharmaceutical fluid and a fill tube and a discharge tube associated in a fluidtight manner with the at least one of fill and discharge orifice, an outer container comprising an outer receptacle, the outer receptacle comprising a wall forming an outer chamber, the entire inner bag being placed in the outer chamber of the outer container, an expandable protective element arranged at least partially between the outer receptacle and the inner bag and adapted to receive the inner bag, the expandable protective element being adapted to expand in volume to an expanded state so as to be interposed between the outer receptacle and the inner bag, wherein the expandable protective element in the expanded state surrounds the inner bag and fills the space between the wall of the outer receptacle and the inner bag, wherein the expandable protective element is inflatable, the expandable protective element being provided with an injection orifice providing a passage for injection of inflation gas, the injection orifice being in fluid communication with the protective element, the injection orifice associated by a fluidtight connection with a first end of an injection tube, the injection tube having at an opposite second end an inlet for the injection of inflation gas into the expandable protective element, the inner bag being provided with a fill orifice for filling with biopharmaceutical fluid and a discharge orifice for discharging biopharmaceutical fluid, and, in fluidtight association with the fill orifice and the discharge orifice, the fill tube having a fill inlet for filling the chamber with biopharmaceutical fluid, adapted to be associated with a line for filling with biopharmaceutical fluid, and the discharge tube having a discharge outlet for draining biopharmaceutical fluid from the chamber, adapted to be associated with a fluid discharge line, a system for inflating the expandable protective element, comprising a member adapted and intended for supplying a pressurized inflation gas having a line for the injection of pressurized inflation gas, able to be associated in fluid communication or being associated in fluid communication with the injection orifice for the injection of pressurized inflation gas of the expandable protective element of the device, the system also comprising a member for controlling and managing the pressure of the pressurized inflation gas in the line for the injection of pressurized inflation gas, a fill line and a discharge line which are adapted to be associated in fluid communication or are associated in fluid communication at the outlet respectively of the fill orifice and the discharge orifice of the device.

27. A method for receiving and transferring a biopharmaceutical fluid, wherein a system is provided for receiving and transferring under controlled pressure a biopharmaceutical fluid according to claim 26, and when one wishes to transfer under controlled pressure the biopharmaceutical fluid from the inner chamber, the line for the injection of pressurized inflation gas and the inlet for the injection of pressurized inflation gas of the protective element are placed in fluid communication, then the pressurized inflation gas is injected into the protective element so that the inner bag and is compressed and the pressure drains the biopharmaceutical fluid therein.

28. A method for receiving and transferring a biopharmaceutical fluid according to claim 27, wherein the one orifice for at least one of fill and discharge of biopharmaceutical fluid includes a discharge orifice, wherein, during discharge, the discharge orifice is positioned in the lower portion of the inner bag.

29. A method for receiving and transferring a biopharmaceutical fluid according to claim 27, wherein the inflation gas is injected such that the pressure of the biopharmaceutical fluid in the discharge outlet remains constant during the discharge.

* * * * *